US008037554B2

(12) United States Patent
Miranda Melo et al.

(10) Patent No.: US 8,037,554 B2
(45) Date of Patent: Oct. 18, 2011

(54) APPARATUS FOR FLUSH TOILET

(76) Inventors: Amarildo Miranda Melo, Campo Grande (BR); Florencio Argemon Neto, Campo Grande (BR)

( * ) Notice: Subject to any disclaimer, the term of this patent is extended or adjusted under 35 U.S.C. 154(b) by 992 days.

(21) Appl. No.: 11/885,403

(22) PCT Filed: Nov. 14, 2006

(86) PCT No.: PCT/BR2006/000249

§ 371 (c)(1),
(2), (4) Date: Aug. 29, 2007

(87) PCT Pub. No.: WO2007/079557

PCT Pub. Date: Jul. 19, 2007

(65) Prior Publication Data

US 2008/0263758 A1 Oct. 30, 2008

(30) Foreign Application Priority Data

Jan. 11, 2006 (BR) ..... 0600284

(51) Int. Cl.
*E03D 11/18* (2006.01)
*E03D 11/00* (2006.01)

(52) U.S. Cl. ..... 4/422; 4/420

(58) Field of Classification Search ..... 4/420–422, 4/353–419, 249
See application file for complete search history.

(56) References Cited

FOREIGN PATENT DOCUMENTS

| | | |
|---|---|---|
| GB | 2 370 586 | 7/2002 |
| JP | 6240729 | 8/1994 |

*Primary Examiner* — Lori Baker
(74) *Attorney, Agent, or Firm* — Hedman & Costigan, P.C.; Kathleen A. Costigan

(57) ABSTRACT

A toilet flush regulator mechanism driving the discharge of water from the flush tank together with the change of geometrical positioning of the curve that forms the toilet siphon; the driving is performed through a system of stems and plates connected among each other by rods, springs and pins joined to the toilet's movable siphon which goal is saving and rationalize the waste of water during the flush. The system works by acting on a driving lever (3) which simultaneously opens the flush storage tank to empty it and moves the curve (10), acting as siphon, to evacuate the toilet bowl into the building's sewer inlet (12) line. While emptying the flush tank the stem with float (1) frees the movement of the other parts joined to it closing the flush tank so it can be filled again, bringing all the mechanism's parts and the curve (10) to the resting initial position.

1 Claim, 5 Drawing Sheets

APPARATUS FOR FLUSH TOILET

FIELD OF THE INVENTION

It concerns a flush apparatus for a toilet comprising a set of mechanical means and a curved moving pipe at the bottom of the toilet bowl acting as a hydraulic siphon than changing its position and temporarily eliminating said siphon. The achieving goal is avoiding the excessive waste of water and than saving it by cutting down the flush volume.

DESCRIPTION OF THE PRIOR ART

Presently, the water usage and its distribution have turned out to be a worldwide real problem, matter-of-factly in Brazil. The WHO—World Health Organization foresees that within a few decades potable water will be one of the most scarce resources as well as the most sought after in the planet, existing only about 0.01% of the total amount available today. Problems like this one turn up the main source to search for new ways to effectively lesser the water's usage, trying to preserve this resource and using it rationally. It is also known that in a town, city and the like, one of the greatest wasters of water is the toilet flush due to around 14% of the whole daily, home water consumption. Many saving actions have been taken such as placing six liters storage tanks in the place of the old flush water storage tanks and using a flushing regulating device, but there still are many problems such as the toilet bow drainage obstruction and the excessive long flushing period. There are different types of regulating devices to save toilet flush water which scope is reducing the volume of water during flush. These devices' basic principle is limiting in some way the flow of water to only the necessary volume by means of different methods.

Different types of toilet flushing regulating devices are being used for saving and rationalizing water usage. The assembling of the present invention makes it differ from those existing ones because besides regulating the flow even with the lever being pushed continuously it also avoids, by means of its siphon, clogging problems. Some existing patents, e.g., US2005188454, US2005155143, JP2005105581, CN1563618, PI0400444-2 and PI0104002-2 present some similarity. Nevertheless, these ones do not present the characteristics of the present invention; they have the same goal of saving water; some ones present a different geometric shape of the siphon; others through differentiated mechanisms.

SUMMARY OF THE INVENTION

The present invention comprises a toilet flush regulator mechanism driving the discharge of water from the flush tank together with the change of the geometrical position of the curve forming the toilet siphon. The driving is performed through a system of stems and plates connected among each other by rods, springs and pins. It is characterized by joining together mechanical means such as levers, plates, springs, stops and pins as well as flexible means such as rods. It is due to reduce the volume of water used to perform the toilet flush. The object of the system hereby described is to improve the toilet flush system through a regulator mechanism of the water inside the flush water tank and to present changes to the curve forming the toilet hydraulic siphon. The toilet flush regulator mechanism leaves the siphon momentarily out of operation lessening the possibility of clogging; the mechanism assembling avoids the excessive waste of water even if the user keeps the flush water tank outlet valve open by acting continuously on the driving lever.

DESCRIPTION OF THE INVENTION

Figure 1:
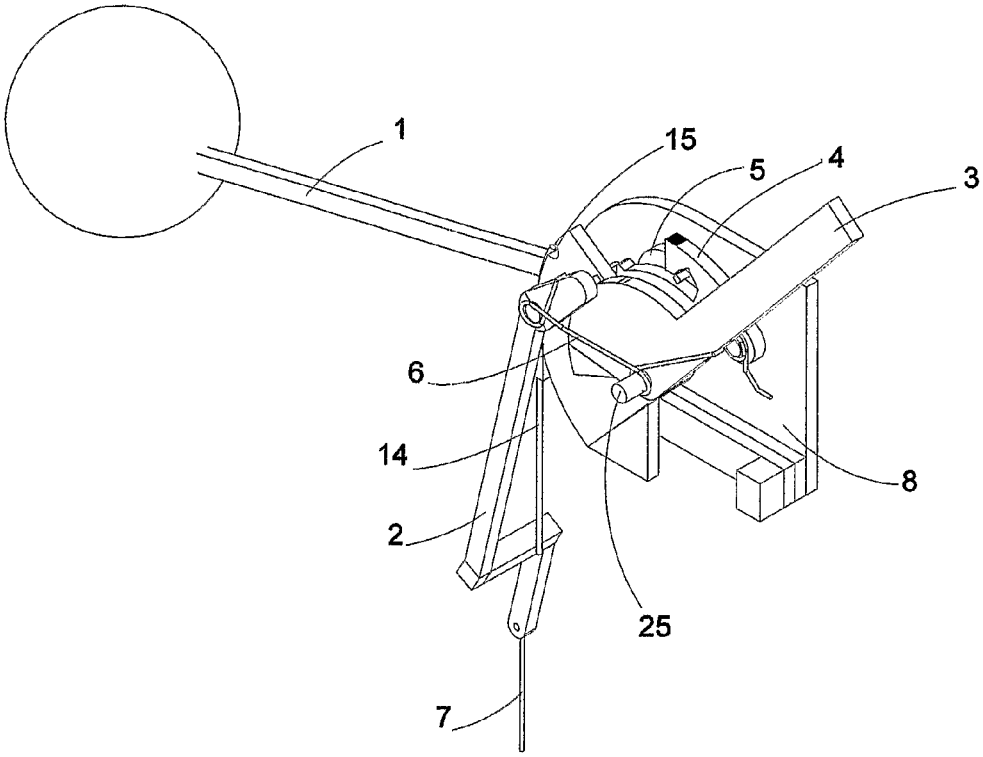
FIG. 1 is a perspective view of the flush driving mechanism when the tank is filled of water, showing the stem with float (1); the driving stem (2) of the curve (10); the driving lever (3) of the discharge system of the water filling the flush tank, rotating related to structural plate (8); the locking gear (4) rotating related to structural plate (8); the trigger (5) rotating related to structural plate (8); the return spring (6); the driving rod (7) of the curve (10); the driving rod (14) for opening the discharge valve discharging the water filling the flush tank.
Figure 2:
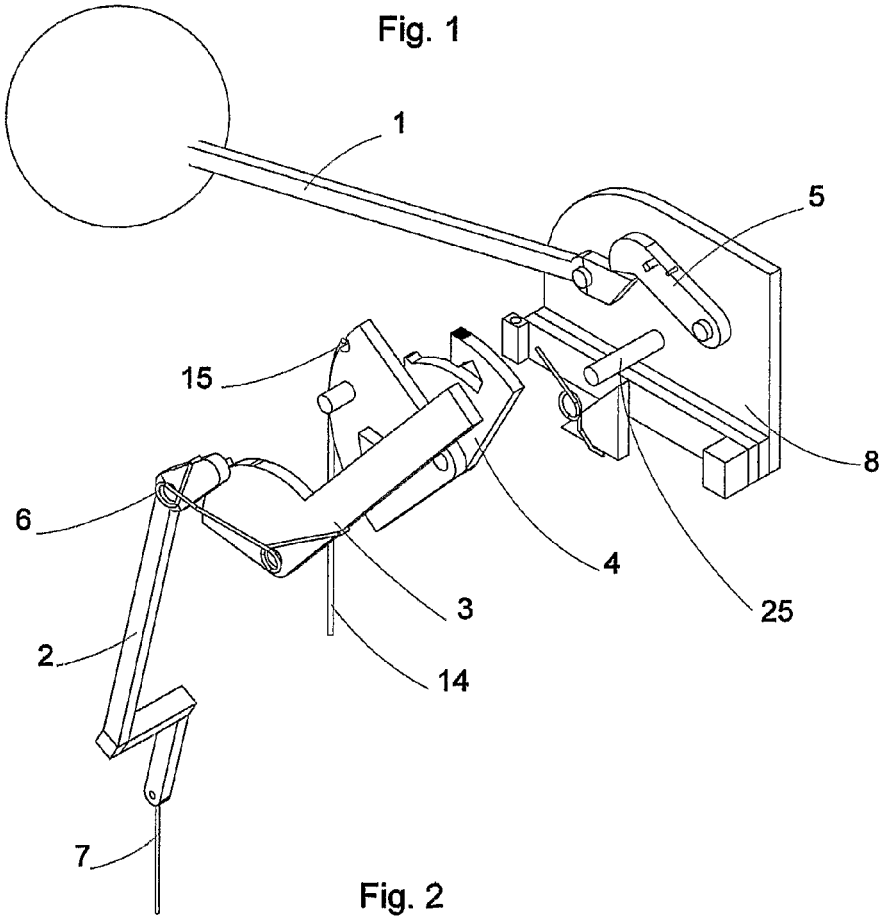
FIG. 2 is an exploded perspective view of the flush driving mechanism showing the stem with float (1); the driving stem (2) of the curve (10); the driving lever (3) of the discharge system of the water filling the flush tank; the locking gear (4); the trigger (5); the return spring (6); the driving rod (7) of the curve (10); the driving rod (14) for opening the discharge valve discharging the water inside the flush tank; the rod (14) is hitched (15) on the edge of the locking gear (4).
Figure 3:
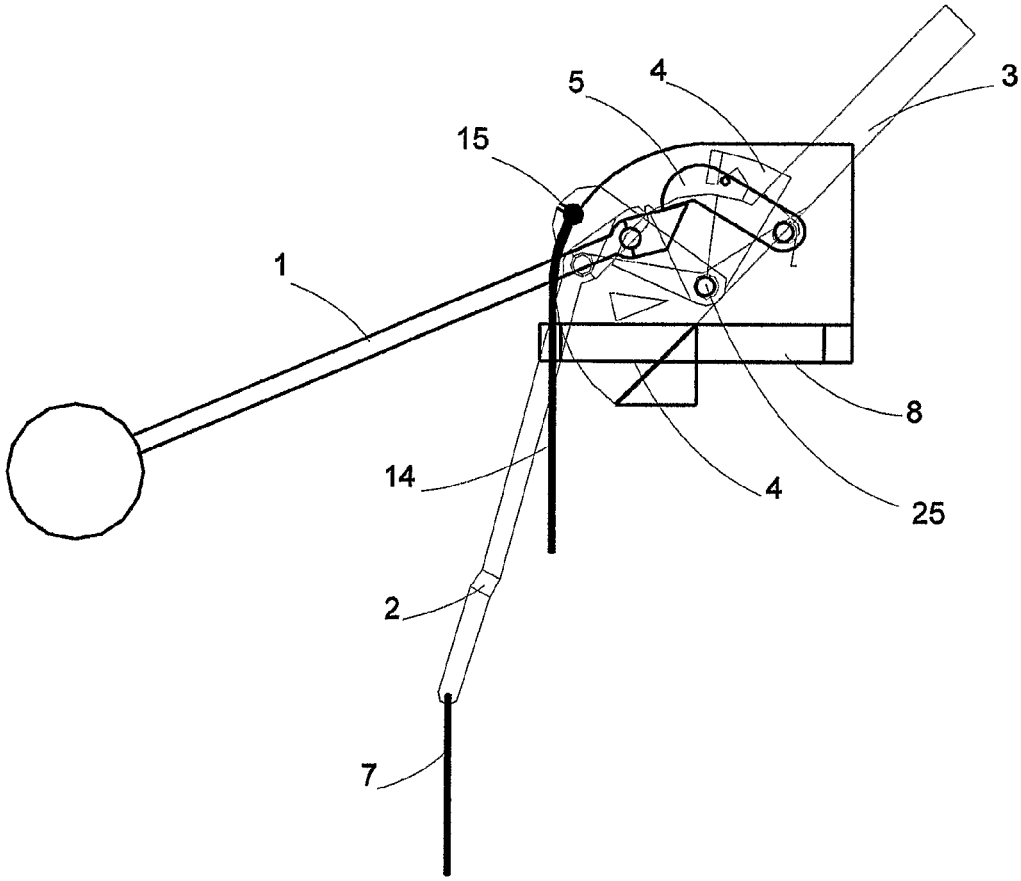
FIG. 3 is a side view of the mechanism representing the position when the level of water in the flush tank is maximum and ready to be used, showing the stem with float (1); the driving stem (2) of the curve (10) at resting position; the driving lever (3) of the discharge system of the water filling the flush tank at resting position; the locking gear (4); the trigger (5); the driving rod (7) of the curve (10) at resting position; the driving rod (14) for opening the discharge valve discharging the water filling the flush tank, being the valve closed.
Figure 4:
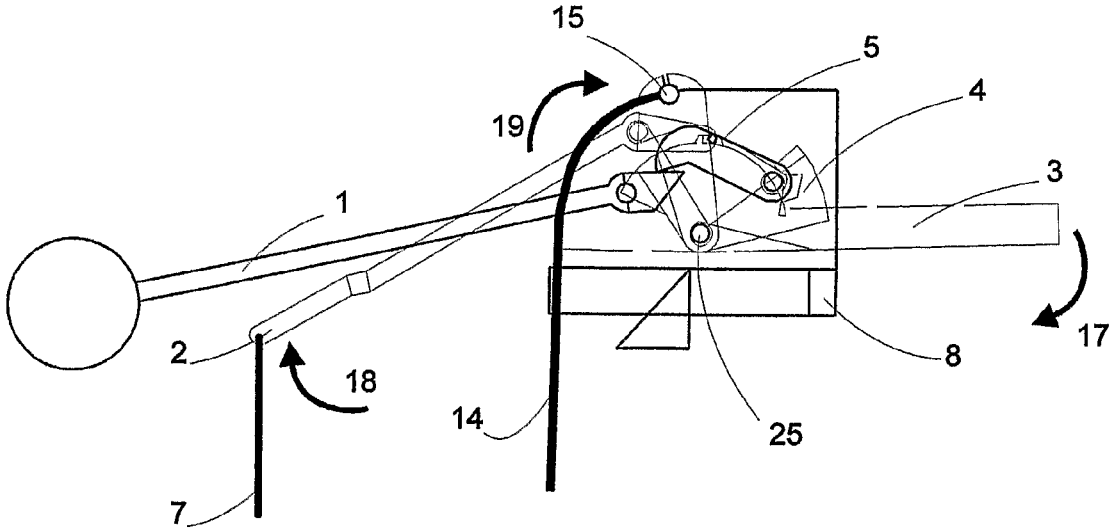
FIG. 4 is a side view of the mechanism representing how it works when the lever (3) is driven (17) still being the level of water in the flush tank maximum, showing the stem with float (1) still at the highest level of water; the driving stem (2) of the curve (11) at driven position (18); the driving lever (3) of the discharge system of the water filling the flush tank at driven position; the locking gear (4); the trigger (5); the driving rod (7) of the curve (10) at driven position; the driving rod (14) to open (19) the discharge valve discharging the water filling the flush tank, being the valve opened.
Figure 5:
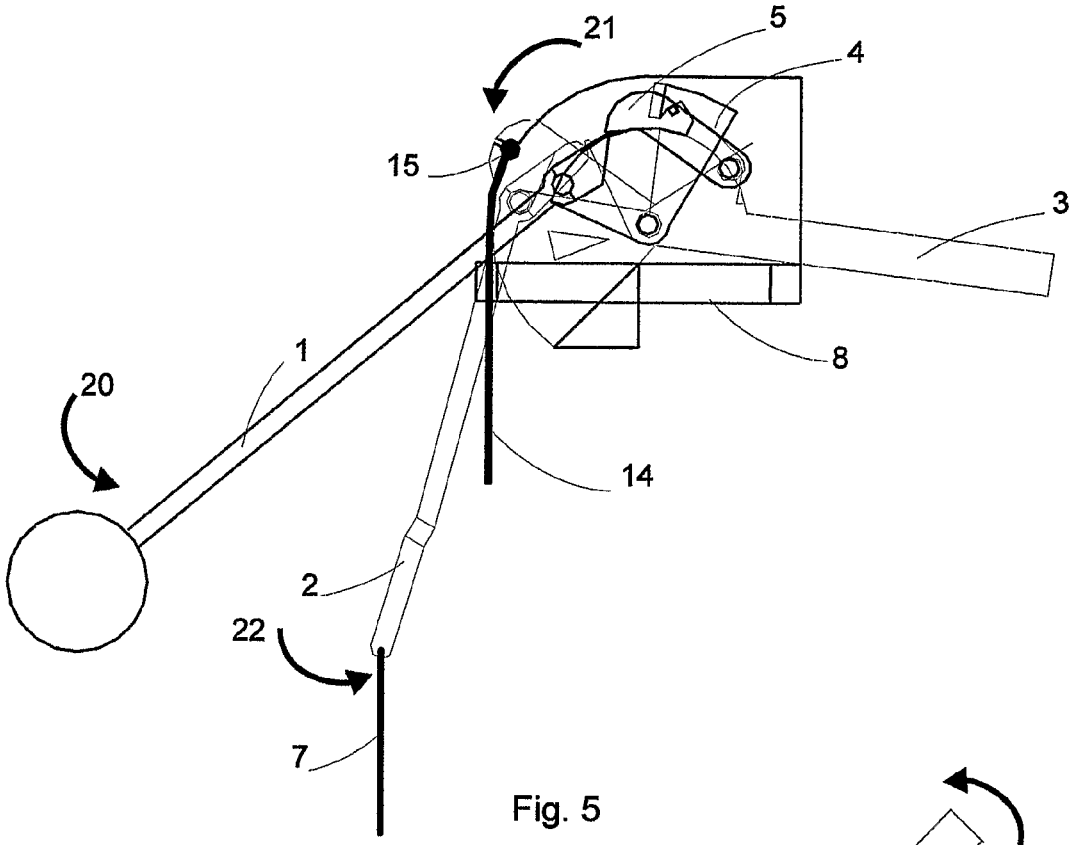
FIG. 5 is a side view of the mechanism representing how it works when lever (3) is still driven (17) being the flush water tank empty, showing the stem with float (1) at the minimum level (20) of water; the driving stem (2) of the curve (10) returning (22) to the resting position; the driving lever (3) of the discharge system of the water filling the flush tank still at driven position; the locking gear (4); the trigger (5); the driving rod (7) of the curve (10) returning (22) to the resting position; the driving rod (14) for opening the discharge valve discharging the water filling the flush tank returning (21) to the valve closed position.
Figure 6:
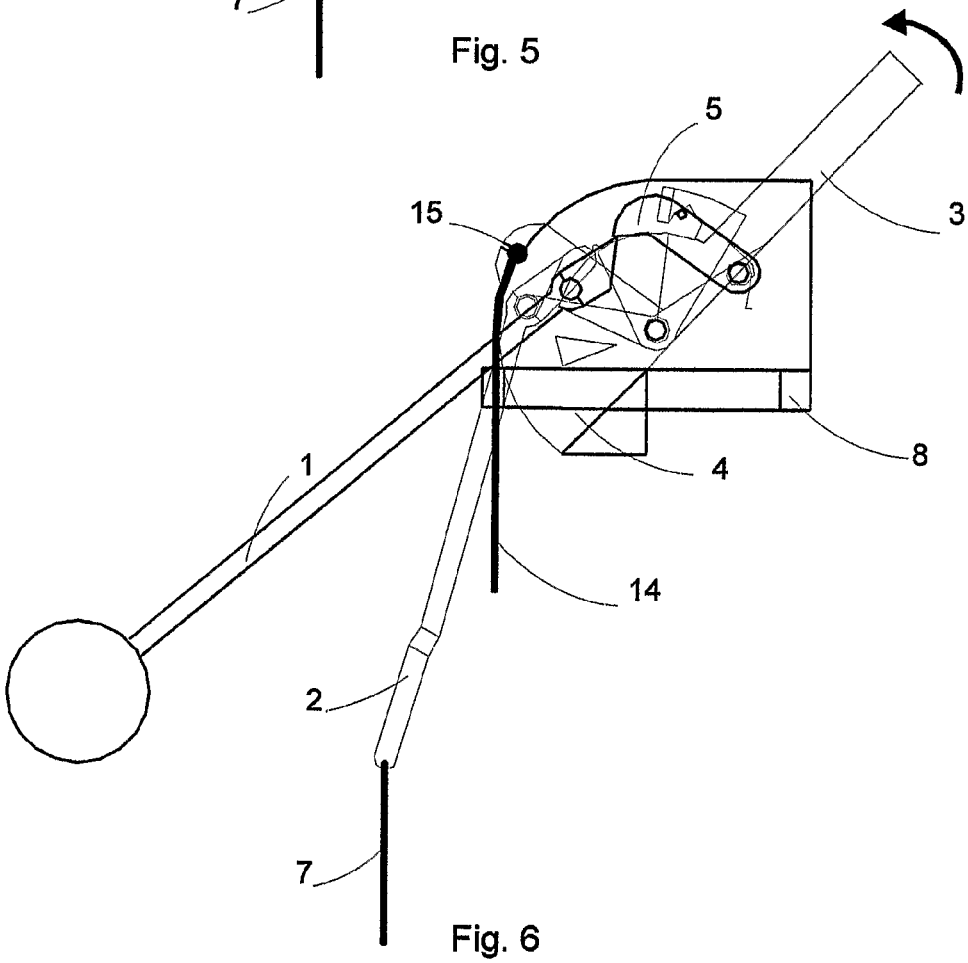
FIG. 6 is side view of the mechanism being the flush water tank empty and the driving lever (3) returning (21) to the resting position, showing the stem with float (1); the driving stem (2) of the curve (10) at resting position; the driving lever (3) of the discharge system of the water inside the flush tank at resting position (21); the locking gear (4); the trigger (5); the driving rod (7) of the curve (10) at resting position; the driving rod (14) for opening the discharge valve discharging the water filling the flush tank, being the valve closed.
Figure 7:
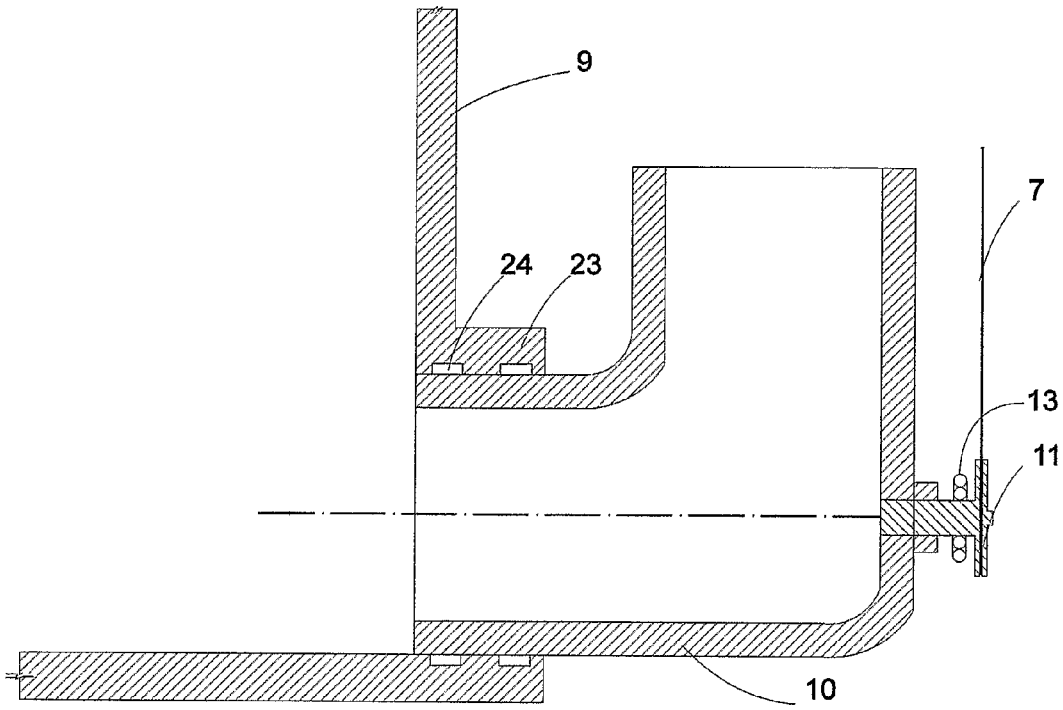
FIG. 7 is a transversal section side view of the curve (10) of the water closet (9) showing the water closet (9); the curve (10) coupled to the bottom wall of the water closet or toilet (9) by means of a flange (23) and retainers (24); aligned with the rotation axis of the curve (10) is fixed a pulley (1) driven by rod (7); on the axis of the pulley (1) there is a spring (13) which rotates said curve (10).
Figure 8:
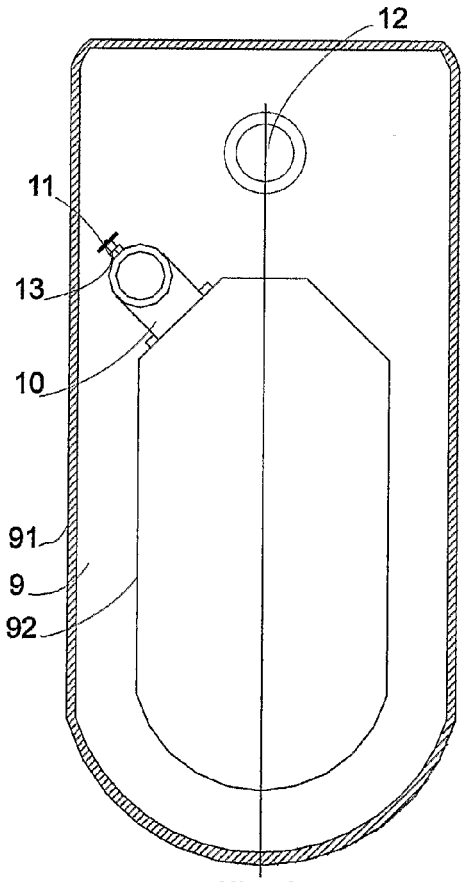
FIG. 8 is a schematic transversal section top view of the toilet showing the curve (10) at its resting position acting as a hydraulic siphon of the toilet; the outer wall (91) and the inner wall (92) of the toilet (9); the curve (10) flanged to the inner wall (92) with the pulley (11) and spring (13); the inlet (12) to the building's sewer line.
Figure 9:
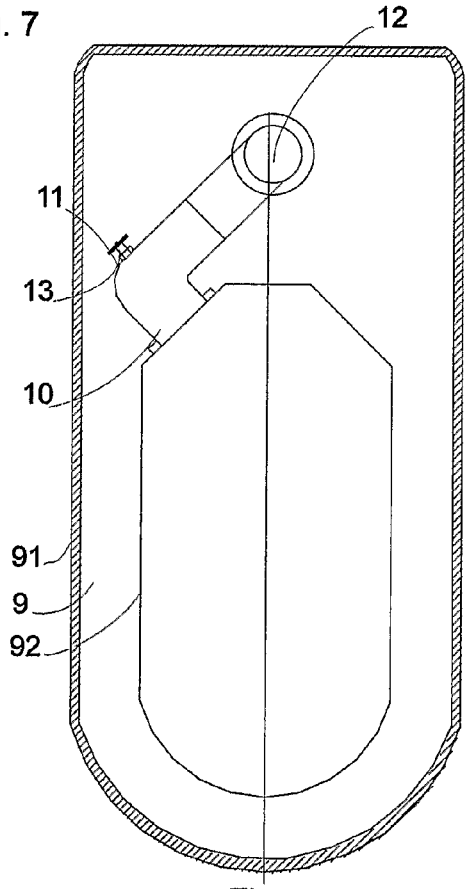
FIG. 9 is a schematic transversal section view of the toilet showing the curve (10) being used as a channel to evacuate the bowl to the sewer line; the outer wall (91) and the inner wall (92) of the toilet (9); the curve (10) flanged to the inner wall (92) with the pulley (11) and spring (13); the inlet (12) to the building's sewer line.
Figure 10:
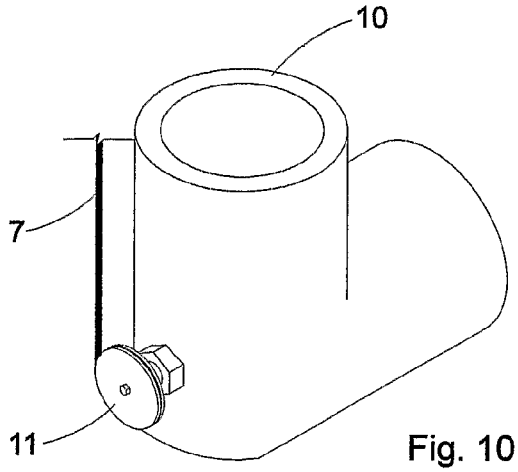
FIG. 10 is a schematic perspective view showing the curve (10), the pulley (11) aligned with the rotation axis of the curve (10); the driving rod (7) which turns the pulley (11) and consequently turning the curve (10).
Figure 11:
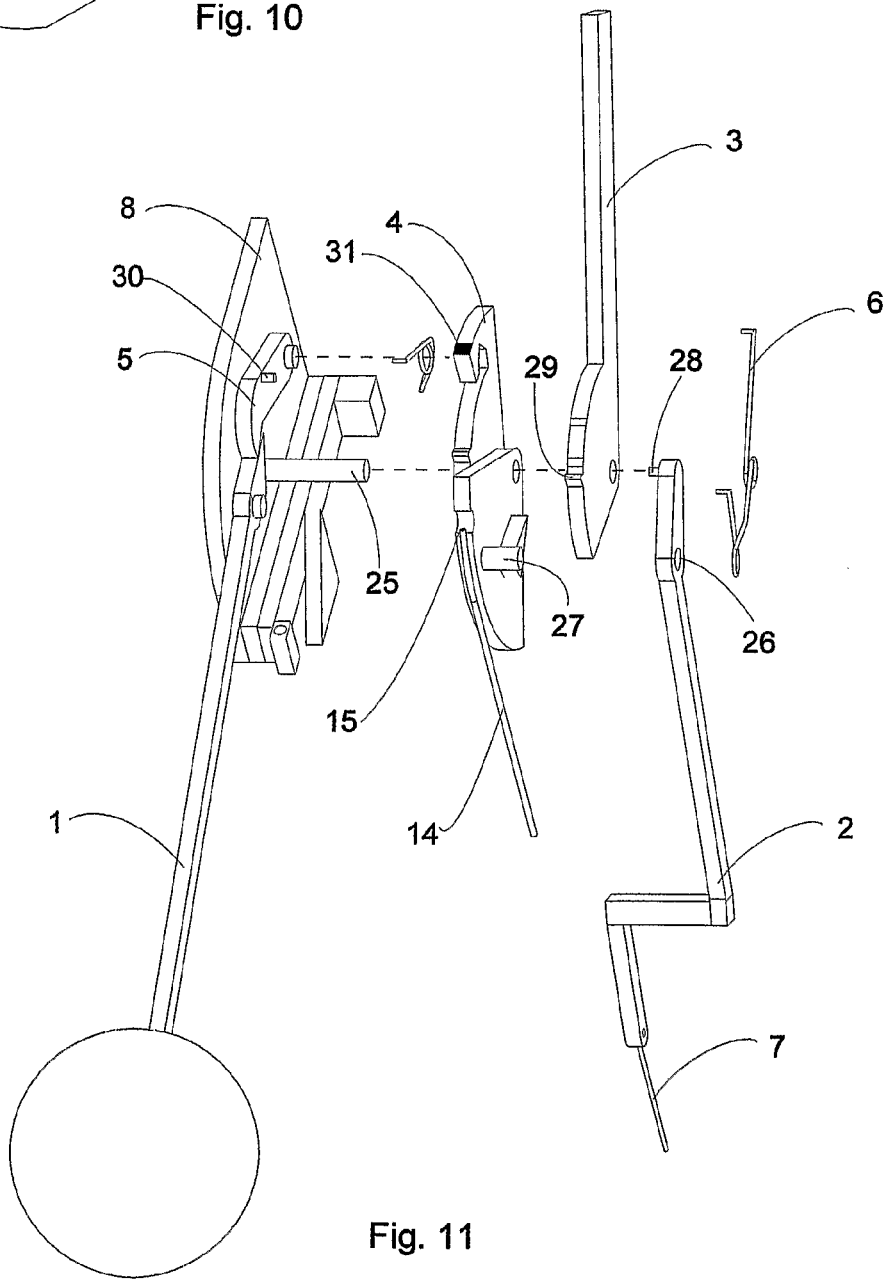
FIG. 11 is a perspective explode view of the flush driving mechanism seen from a different angle from that one shown in FIG. 2, showing the stem with float (1); the driving stem (2) with a hole (26) of the curve (10); the driving lever (3) of the discharge system of the water filling the flush tank; the locking gear (4); the trigger (5); the return spring (6); the driving rod (7) of the curve (10); the driving rod (14) for opening the discharge valve discharging the water filling the flush tank; the rod (14) is fixed at the hitching point (15) on the locking gear's edge.

To start, assume the flush storage tank is full of water. Pulling the driving lever (3) it pulls the locking gear (4) and the driving stem (2) of the curve (10). The locking gear (4) being pulled by the driving lever (3) pulls the driving rod (14) and consequently opening and emptying the flush tank. But when the driving stem (2) of the curve (10) is pulled it will track the driving rod (7) which will turn the pulley (11) coupled to the rotation axis of the curve (10); when the pulley (11) is turned it presses a spiral spring (13) which, being assembled on the rotation axis of the curve (10), returns the curve (10) to its initial position as soon as the tracking of the driving rod (7) ceases. While the curve (10) is being tracked by the driving rod (7) the toilet bowl is being freely evacuated to the inlet (12) of the building's sewer line. As the water level inside the flush storage tank decreases, the stem with float (1) acts as a lever at the trigger (5) loosening the system and making the driving stem (2) return to its initial position by means of return spring (6) action. During the process of evacuating the toilet bowl into the inlet (12) sewer line the flush storage tank will be emptying moving downward the stem with float (1) that simultaneously moves the driving stem (2) of the curve (10), the driving lever (3) and the locking gear (4) until the trigger (5) locks the system. The locking gear (4) will also move the return spring (6) than closing the inlet of the flush storage tank allowing it to fill again. The driving stem (2) returning movement frees the spring (13) coupled to the curve (10) bringing the curve (10) to its original position. At the original position the curve (10) acts as a toilet's hydraulic siphon. It is to be noticed that in this returning movement, even if the user keeps pulling the driving lever (3), the system will return to its original position due to the movement of the stem with float (1) that moves all the other parts of the assembly than achieving the so desired water saving.

The system has a so called structural plate (8) with a pin (25) perpendicularly fixed to its lateral surface acting said pin (25) as a rotation axis for the locking gear (4 which is a plate parallel to the structural plate (8), for the driving lever (3), for the stem with float (1) and for the trigger (5); the locking gear (4) has a pin (27) perpendicularly fix to its lateral surface acting as a rotation axis through the hole (26) for the driving stem (2) of the curve (10) which acts as a discharge siphon to the toilet (9). The locking gear (4) has a hitch (15) at one of its edges to hitch the driving rod (14) that opens the flush tank's discharge valve. The locking gear (4) has a boss (31) at one of its edges acting as a stop to the pin (30) which is perpendicularly fixed to the lateral surface of the trigger (5). The driving lever (3) has at one of its edges a boss (29) acting as a stop to the pin (28) perpendicularly fixed to said driving stem (2). This driving stem (2) has a driving rod (7) hitched to one of its ends. The other end of said driving rod (7) is winded up around the pulley (11) which is flanged to the curve (10) which is 90 degree hydraulic connection type acting as a siphon to the toilet (9). The curve (10) rotates related to the inner wall (92) of the toilet (9). When the curve (10) is in its vertical position and acting as siphon, the plane containing said curve (10) forms a 45 degree angle with the plane containing the longitudinal axis of said toilet (9). The said stem with float (1) acts as a lever to said trigger (5).

This is an apparatus of industrial usage manufactured with mechanical parts available at the retail market.

The invention claimed is:

1. A toilet flush regulator mechanism comprising:

a movable siphon for evacuating the bowl of a toilet, said movable siphon having a structural plate (8) with a first pin (25) perpendicularly fixed to a lateral surface of said movable siphon, whereby said pin (25) is adapted to act as an axis of rotation for a locking gear (4) that is positioned parallel to said structural plate (8); said first pin (25) being adapted to act as a rotation axis for a driving lever (3); a stem with a float (1) and a trigger (5) which rotate relative to said structural plate (8); a second pin (27) perpendicularly fixed to a lateral surface of said locking gear (4), said second pin (27) being adapted to act as an axis of rotation for a driving stem (2) by being attached to said driving stem (2) through hole (26) to curve (10) which is a siphon for evacuating a bowl of a toilet (9); said locking gear (4) having a hitch (15) at one of its edges; said locking gear (4) having a boss (31) adapted to act as a stop to the pin (30) which is fixed perpendicularly to a lateral surface of a trigger (5) that is acted on by a third stem having a float; said driving lever (3) having a boss (29) at an edge that is adapted to act as a stop for a third pin (28) that is perpendicularly fixed to a lateral surface of said driving stem (2); wherein a second driving rod (7) having a first end and a second end where said first end is hitched to an end of said driving stem (2) and the and the second end is attached to a pulley (11); said pulley (11) being attached to the curve (10), said curve (10) having a 90 degree hydraulic connection, which is a siphon to toilet (9); said curve (10) being rotatable in relation to an inner wall (92) of said toilet (9); and said curve (9) being in a vertical plane when a siphon forms a 45 degree angle with a plane containing a longitudinal axis of said toilet (9).

* * * * *